United States Patent [19]

Allen

[11] 4,249,327

[45] Feb. 10, 1981

[54] FINE GRADER

[75] Inventor: J. Dewayne Allen, Paragould, Ark.

[73] Assignee: Allen Engineering Corporation, Paragould, Ark.

[21] Appl. No.: 23,904

[22] Filed: Mar. 26, 1979

[51] Int. Cl.[3] ..... E01C 19/38

[52] U.S. Cl. ..... 404/114; 404/119

[58] Field of Search ..... 404/119, 118, 106, 101, 404/96, 114, 75, 72; 37/108 A, 117.5

[56] References Cited

U.S. PATENT DOCUMENTS

| | | | |
|---|---|---|---|
| 1,532,841 | 4/1925 | Stayton | 404/106 |
| 1,768,663 | 7/1930 | Carr | 404/96 X |
| 1,954,104 | 4/1934 | Schuster | 404/119 |
| 2,965,987 | 12/1960 | Graves | 404/106 X |
| 2,976,784 | 3/1961 | Perkins | 404/119 |
| 3,110,234 | 11/1963 | Oster | 404/119 |
| 3,113,494 | 12/1963 | Barnes | 404/114 |
| 3,164,072 | 1/1965 | Blankenship | 404/96 |
| 3,396,642 | 8/1968 | Martinson | 404/114 |
| 3,435,740 | 4/1969 | McGall | 404/119 X |

*Primary Examiner*—Nile C. Byers, Jr.

*Attorney, Agent, or Firm*—Duckworth, Hobby, Allen & Pettis

[57] ABSTRACT

A fine grader for fine grading the surface of the subgrade on which fresh concrete is to be poured to form a uniformly level surface for receiving freshly poured concrete is formed by coupling together a fine grader attachment with a vibratory screed. The screed includes first and second ends and first and second end brackets which are coupled to the first and second ends of the screed frame. A winch is coupled to each end bracket for translating the screed along the length of the side forms. The fine grader attachment for the screed includes a fine grader blade, a series of brackets coupled to the screed frame and to the fine grader blade for maintaining the blade in a grading position below and in front of the screed. A plurality of pneumatic motors impart a vibratory motion to the frame while a network of brackets and struts transmits the vibratory motion of the frame to the fine grader blade to permit the vibratory motion of the fine grader blade against the surface of the subgrade to form a uniformly level surface as the frame is translated along the length of the side forms.

14 Claims, 3 Drawing Figures

FINE GRADER

BACKGROUND OF THE INVENTION

1. Field of the Invention

The present invention relates to earth grading equipment, and more particularly, to a fine grader for fine grading the surface of a subgrade on which fresh concrete is to be poured.

2. Description of the Prior Art

A wide variety of related devices are disclosed in the prior art. U.S. Pat. No. 4,030,873 (Morrison) discloses a multiple section, varibable length vibratory screed which is translatable along the length of parallel oriented side forms for screeding the upper surface of freshly poured concrete.

U.S. Pat. No. 1,768,663 (Carr) discloses a tractor-drawn earth mold making machine which is translatable along the length of parallel oriented tracks which are positioned adjacent to an area in which concrete is to be poured. This device includes a plurality of blade sections and bracket means coupling each blade section to a horizontally oriented frame to permit independent orientation of each blade section with respect to the surface being graded. The bracket means permit the device to form the desired contour for the subgrade.

U.S. Pat. No. 3,352,036 (Miller) discloses a related type of fine grading apparatus which includes a plurality of hydraulic rams and associated linkage to adjust the width of the device and to vary the blade height of the device as required. U.S. Pat. No. 3,901,619 ('Agata) discloses a tractor-drawn grader which includes structure to permit the blade width, height and angle to be readily adjusted.

U.S. Pat. No. 1,949,151 (Fanfarillo) discloses a tractor-drawn roadway subgrader which is linerally translated along parallel oriented side rails and which includes a curved blade. U.S. Pat. No. 1,846,138 (Moore) discloses a concrete screed having a two element blade for imparting a contour to the upper surface of the concrete. The two ends of the screed overlap and are translated along a pair of parallel oriented side rails.

Other related prior art is disclosed in the following U.S. Pat. Nos. 1,978,464 (Leydecker); 1,936,209 (Reiland); 1,876,283 (Ennis); 1,741,825 (Carr) and 1,940,659 (Baker).

SUMMARY OF THE INVENTION

The present invention contemplates a concrete screed which operates in combination with a fine grader attachment to fine grade the surface of the subgrade on which fresh concrete is to be poured to form a uniformly level surface for receiving the freshly poured concrete. The screed comprises a frame having first and second ends and includes first and second end brackets coupled to the first and second ends of the frame. Means coupled to the frame of the screed is provided to translate the screed along the length of the side forms. The fine grader attachment comprises a fine grader blade and bracket means which is coupled to the frame of the screed and to the fine grader blade to maintain the blade in a grading position below and in front of the screed frame. Means is coupled to the frame for imparting vibratory motion to the frame. Means coupled to the frame and to the bracket means is also provided to transmit the vibratory motion of the frame to the fine grader blade to permit the vibratory motion of the fine grader blade against the surface of the subgrade to form a uniformly level surface as the frame is translated along the length of the side forms.

An important aspect of the present invention resides in the ease with which the fine grader attachment can be either adjusted vertically and removed from or attached to the screed to permit a single piece of equipment to either fine grade the surface of the subgrade on which fresh concrete is to be poured or to screed the upper surface of freshly poured concrete.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
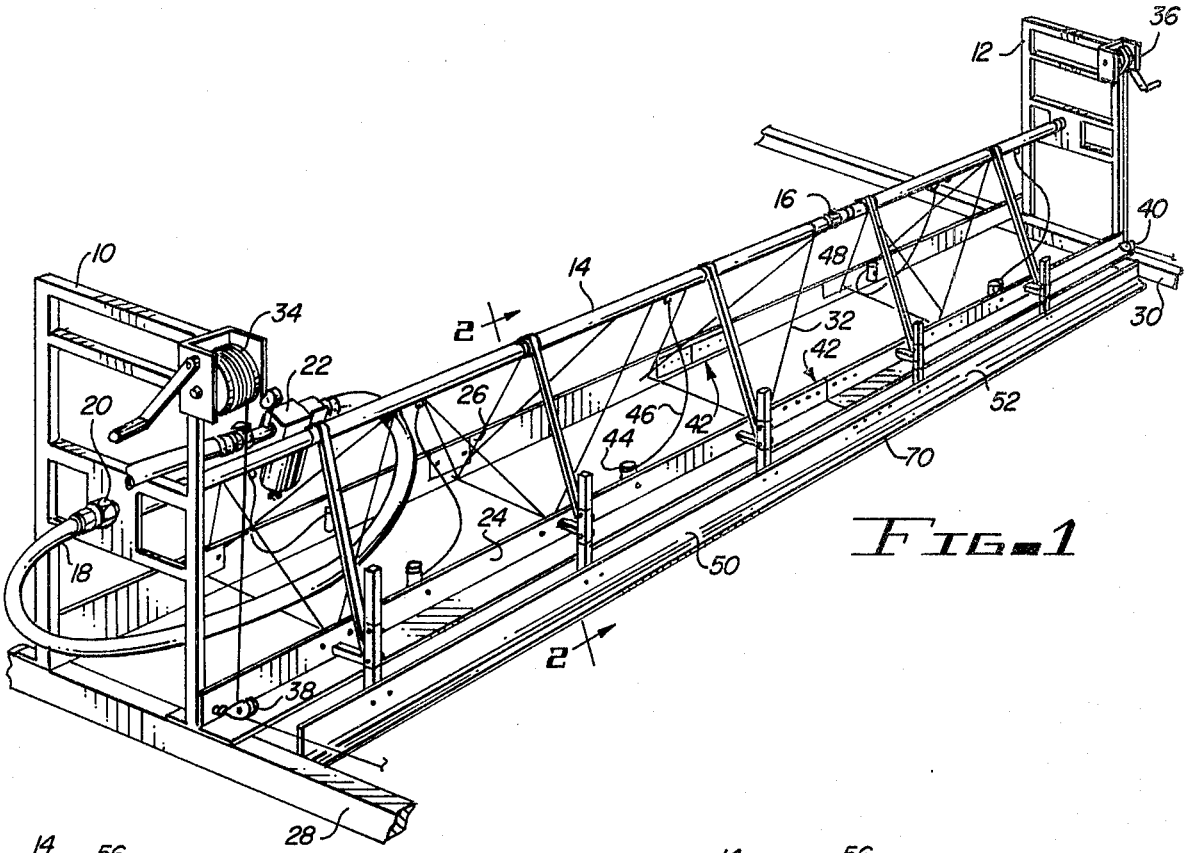
FIG. 1 is a perspective view of the fine grader illustrating the manner in which the fine grader is laterally translatable along the length of a pair of parallel oriented side members.

Referring now to FIG. 1, the fine grader of the present invention includes a concrete screed and a fine grader attachment. The screed includes first and second ends to which first and second end brackets 10 and 12 are coupled. A horizontally oriented support member in the form of a hollow tubular member 14 is coupled to end brackets 10 and 12 and includes a quick disconnect coupling 16 which facilitates rapid assembly/disassembly of the unit. A length of flexible air hose 18 is coupled by another quick disconnect fitting 20 to the end of tubular member 14 which extends through end bracket 10. An air filter/lubricator unit 22 is coupled in series with air hose 18 to filter the pressurized air which is provided by a remotely located air compressor (not shown) and which also supplied oil for lubricating the pistons of the pneumatic vibratory units.

An inverted T-shaped front screed blade 24 and a rear bullfloat blade 26 are coupled at each end to end brackets 10 and 12 and are slidably translatable along the upper surface of parallel oriented side members 28 and 30. An open network of metal rods, such as rod 32, are welded together and joined at various points to front and rear screed blades 24 and 26 and to tubular member 14 to form an open truss assembly which maintains the screed in a rigid position which supports the weight of the various screed components. For purposes of clarity, not all of the truss elements are illustrated in FIG. 1.

A pair of manually operated winches 34 and 36 are coupled to the front side of end brackets 10 and 12. A cable from each winch passes through pulleys 38 and 40 which are coupled to the lower portion of end brackets 10 and 12 to permit rotation of the winch barrels to translate the screed along the length of side members 28 and 30. The end of each winch cable is coupled by a hook or other securing means to a fixed point ahead of the screed. Commercially available power driven winches may also be used to translate the present invention.

The screed is formed in 5½ foot and 7 foot sections and includes coupling unit 42 which incorporates a splice plate and a plurality of securing devices to permit the screed to be readily assembled and disassembled by sections. Quick disconnect unit 16 is located at a position coincident with coupling unit 42.

A plurality of pneumatic motors, such as pneumatic vibrator 44, are coupled to the rear, horizontally oriented portion of front screed blade 24. Each pneumatic vibrator is coupled by an air hose 46 to tubular member 14 in order to provide each pneumatic vibrator with a source of air under pressure. Each pneumatic vibrator includes a vertically translatable piston which oscillates at a rate of four to eight thousand cycles per minute. Pneumatic vibrators of the type utilized in the preferred embodiment of the present invention are of a type available commercially and well known to those skilled in the art. A second plurality of pneumatic vibrators, such as pneumatic vibrator 48, are coupled to the vertically oriented front portion of rear screed blade 26 and are supplied by air in a manner similar to that described in connection with the pneumatic vibrators mounted on front screed blade 24. The pneumatic vibrators coupled to the front and rear screed blades are generally coupled at 30" intervals in staggered positions to permit uniform screeding of the upper surface of freshly poured concrete. Pairs of vibrators may be coupled together to increase vibratory forces.

The fine grader attachment of the present invention is fabricated in sections having a length generally equal to the length of each of the sections of the screed. 7 foot to 5½ foot sections are provided in the preferred embodiment of the invention. In the unit illustrated in FIG. 1, the fine grader blade is fabricated in two sections, namely, sections 50 and 52. The length of each of these two fine grader blade sections may be somewhat shorter than the length of the corresponding sections of the front screed blade 24 to permit fine grader sections 50 and 52 to fit within the vertically oriented, interior surfaces of side members 28 and 30 while the end sections of screed blade 24 extend beyond the edges of side members 28 and 30 and are translatable above the upper surface of side members 28 and 30. Alternatively, since the fine grader sections can be secured at any lateral position to tubular member 14, the blade sections 50 and 52 can be made to overlap each other an amount sufficient to provide the necessary clearance between their opposite ends and the interior surfaces of side members 28 and 30.

Figure 2:
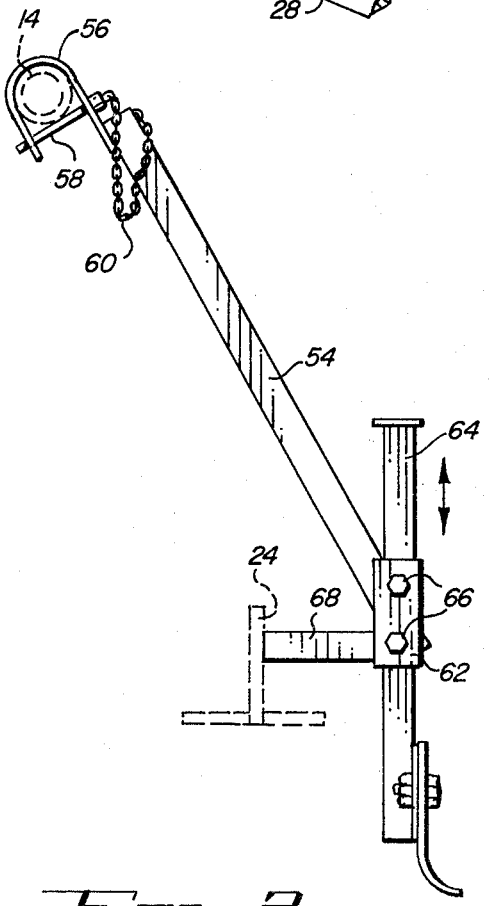
FIG. 2 is a partial sectional view of the fine grader attachment of the present invention as illustrated in FIG. 1, taken along section line 2—2.
Figure 3:
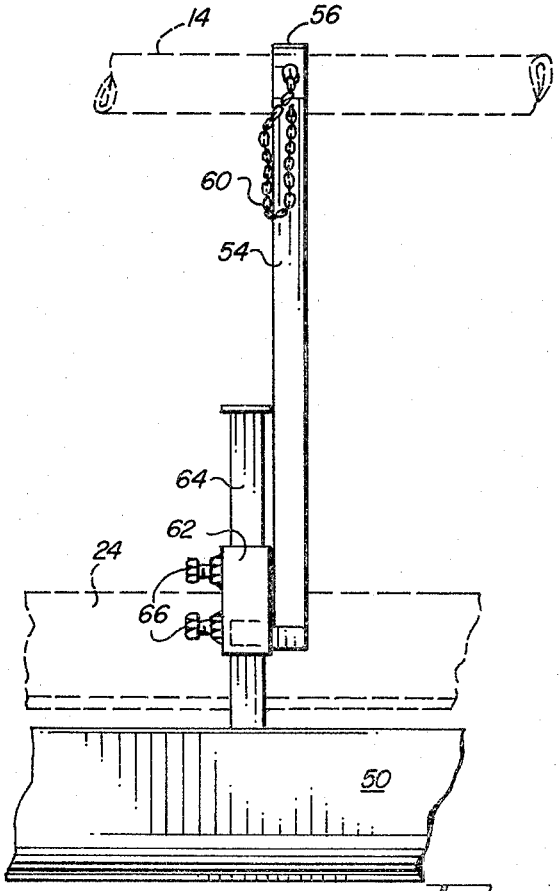
FIG. 3 is a partial elevational view of a portion of the fine grader attachment shown in FIG. 1.

Referring now also to FIGS. 2 and 3, bracket means for coupling the two fine grader blade sections to the screed and for maintaining the fine grader blade sections in a grading position below and in front of the frame of the screed will now be described. The number of bracket sections provided to couple each section of the fine grader attachment to the screed will vary depending on the total length of each screed section. A diagonal bracket section 54 is coupled at one end to a U-shaped member 56 which is configured to pass around and fit closely to the outer circumference of tubular member 14. A pin 58 is coupled by a chain 60 to the end of bracket 54 and passes through a pair of holes in member 56 to permit bracket section 54 to be readily coupled to and decoupled from tubular member 14 at any desired lateral position. Member 56 and pin 58 form coupling means for readily coupling and decoupling the bracket means from the screed.

A short length of rectangular channel stock 62 is coupled to the opposite end of bracket section 54 with a vertical orientation. A vertically oriented member 64 includes a rectangular cross section which matches the rectangular inner dimension of channel stock 62 and is slidably displaceable in a vertical direction. A pair of bolts 66 are threadable attached to the wall of channel stock 62 and serve as clamping means for engaging a side surface of member 64 to lock it in a fixed vertical position. In this manner the elevation of the fine grader blade sections can be readily controlled with respect to the front screed blade 24. As can be seen from FIG. 2 each fine grader blade section includes a forward oriented curve and is coupled to the lower portion of member 64 by securing means such as a bolt and nut. Member 64 and the clamping means form vertical adjustment means for the fine grader attachment.

A horizontally oriented rigid member or strut 68 is coupled to channel stock 62 and extends rearward toward and contacts the vertical face of front screed blade 24. During forward translation of the screed with respect to the subgrade in contact with the fine grader blade sections, the blade sections are deflected toward the face of the front screed blades causing the horizontally oriented strut 68 to transmit the vibratory motion of the screed blade directly to the fine grader blade. The vibratory motion of the fine grader blade thus substantially facilitates the grading of the surface onto which fresh concrete will thereafter be poured.

At the interface between fine grader blade sections 50 and 52 which is indicated by reference number 70, a small overlap is established to prevent the formation of a gap between adjacent blade sections. The overlapping sections of adjacent blade sections are generally centered about coupling unit 42 of the screed.

Coupling unit 16 also includes a turnbuckle-like adjustment unit of a type well known to those skilled in the art for permitting adjustment of the screed orientation with respect to the subgrade surface. Adjustment of coupling unit 16 thus also imparts a contour to the lower surface of the fine grader blade sections, permitting a desired contour to be imparted to the upper surface of the subgrade.

It will be apparent to those skilled in the art that the disclosed fine grader may be modified in numerous ways and may assume many embodiments other than the preferred forms specifically set out and described above. For example, the fine grader might be manufactured as a complete unit having a substantially simplified structural configuration if it were not also intended to readily be adapted to serve as a concrete screed. In this embodiment, numerous modifications would be made to the front and rear screed blades as well as to the related supporting and attachment structures for the fine grader blade sections.

The pneumatic vibrators might also be coupled directly to the fine grader blade in addition to or instead of the manner of coupling illustrated in FIG. 1.

Accordingly, it is intended by the appended claims to cover all such modifications of the invention which fall within the true spirit and scope of the invention.

I claim:

1. In a screed for leveling freshly poured concrete lying in an area between opposing side forms to produce a smooth, finished concrete surface, the screed comprising:

a. a frame having a screed blade;

b. means coupled to the frame for translating the screed along the side forms; and c. means coupled to the frame for imparting vibratory motion to the screed blade;

Wherein the improvement comprises:

a fine grader attachment for the screed for fine grading the surface of the subgrade on which fresh concrete is to be poured to form a predetermined surface contour for receiving the freshly poured concrete, said fine grader attachment including:

(a) a fine grader blade;

(b) bracket means coupled to the frame and to the screed blade for maintaining said fine grader blade in a grading position below and in front of the screed blade; and (c) means rigidly coupled to said bracket means and loosely contacting the screed blade for transmitting the vibrations of the screed blade through said bracket means to said fine grader blade.

2. The fine grader attachment of claim 1 wherein said transmitting means includes a rigid member coupled at one end to said bracket means and extending rearward from said bracket means toward the screed blade.

3. The fine grader attachment of claim 2 wherein said rigid member comprises a horizontally oriented strut coupled at one end to said bracket means and extending rearward therefrom to contact the screed blade.

4. The fine grader attachment of claim 1 wherein said vibratory means includes a plurality of vibrating units coupled at spaced apart intervals along the length of the screed blade.

5. The fine grader attachment of claim 4 wherein said vibrator units are pneumatically driven.

6. The fine grader attachment of claim 1 wherein said bracket means includes a plurality of bracket sections coupled to the screed frame at spaced apart intervals.

7. The fine grader attachment of claim 1 wherein forward movement of the screed biases the transmitting means into firm contact with the vibrating screed blade.

8. The fine grader attachment of claim 1 further including means coupled to said bracket means and to said fine grader blade for vertically adjusting the position of said fine grader blade.

9. The fine grader attachment of claim 8 wherein said vertical adjustment means includes:

a. a member coupled at one end to said fine grader blade; and b. means coupled to said bracket means for clamping said member at a predetermined desired position.

10. The fine grader adjustment of claim 1 wherein the screed frame includes a horizontally oriented support member coupled to the upper part of the screed frame and extending along the length of the frame parallel with the screed blade.

11. The fine grader attachment of claim 10 wherein said bracket means includes means for rapidly coupling and decoupling said bracket means from the horizontally oriented support member.

12. The fine grader attachment of claim 10 wherein said horizontally oriented support member comprises a hollow tubular member coupled to a source of air under pressure for providing a source of pressurized air along the entire length of the screed frame.

13. The fine grader attachment of claim 1 wherein said fine grader is fabricated in sections.

14. A fine grader for fine grading the surface of a subgrade lying in an area between opposing side forms to form a predetermined surface contour for receiving a material, said fine grader including;

a. a frame having a screed blade;

b. means coupled to said frame for translating said fine grader along the side forms;

c. means coupled to said frame for vibrating said screed blade;

d. a fine grader blade;

e. bracket means coupled to said frame and to said screed blade for maintaining said fine grader blade in a grading position below and in front of the screed blade; and f. means rigidly coupled to said bracket means and loosely contacting said screed blade for transmitting vibrations of said screed blade through said bracket means to said fine grader blade.

* * * * *